United States Patent [19]
Behrendt et al.
[11] 4,231,667
[45] Nov. 4, 1980

[54] TYPEWRITER RIBBON FEED MECHANISM

[75] Inventors: Wolfgang Behrendt; Detlef Bohnhage, both of Wilhelmshaven; Peter Friedemann, Zetel; Bernhard Frölich, Spangenberg; Reinhold Orzessek, Schortens, all of Fed. Rep. of Germany

[73] Assignee: Olympia Werke AG, Wilhelmshaven, Fed. Rep. of Germany

[21] Appl. No.: 17,541

[22] Filed: Mar. 5, 1979

[30] Foreign Application Priority Data

Mar. 13, 1978 [DE] Fed. Rep. of Germany ..... 2810768

[51] Int. Cl.[3] ..... B41J 33/14

[52] U.S. Cl. ..... 400/208; 400/227.2; 400/229; 400/232; 400/235.1; 400/236.2

[58] Field of Search ..... 400/194, 195, 196, 196.1, 400/206, 206.1, 207, 208, 227.2, 229, 232, 235.1, 236.2

[56] References Cited

U.S. PATENT DOCUMENTS

| | | | |
|---|---|---|---|
| 3,346,090 | 10/1967 | Goff, Jr. et al. | 400/227.2 X |
| 3,349,887 | 10/1967 | Goff, Jr. | 400/232 X |
| 3,604,549 | 9/1971 | Caudill et al. | 400/227.2 X |
| 3,643,779 | 2/1972 | Anderson et al. | 400/227.2 X |
| 3,967,790 | 7/1976 | Hess | 400/196 X |
| 3,976,183 | 8/1976 | Fleischmann et al. | 400/227.2 X |
| 4,011,933 | 3/1977 | Kern | 400/208 |

OTHER PUBLICATIONS

IBM Technical Disclosure Bulletin, "Variable Pitch Ribbon Feed", Greer, vol. 20, No. 3, Aug. 1977, pp. 1072–1073.

*Primary Examiner*—Ernest T. Wright, Jr.
*Attorney, Agent, or Firm*—Spencer & Kaye

[57] ABSTRACT

A feed mechanism for advancing a cartridged ink ribbon in feeding steps whose length is determined dependent upon the type of the ribbon contained in the ribbon cartridge. The feed mechanism includes a feed roller mounted in the cartridge and operatively connected with the ribbon for advancing the ribbon. The feed mechanism further includes a driving device mounted in the machine and operatively connectable to the drive roller upon insertion of the cartridge in the machine. The driving device has at least two output components arranged to rotate with unlike speeds. The feed mechanism further has a coupling arrangement mounted in the cartridge and continuously operatively connected with the feed roller. The coupling arrangement connects a selected one of the output components to the feed roller when the cartridge is in place in the typing machine. The coupling arrangement is structured such that it connects the feed roller to the selected one of the output components as a function of the type of the associated ribbon.

8 Claims, 5 Drawing Figures

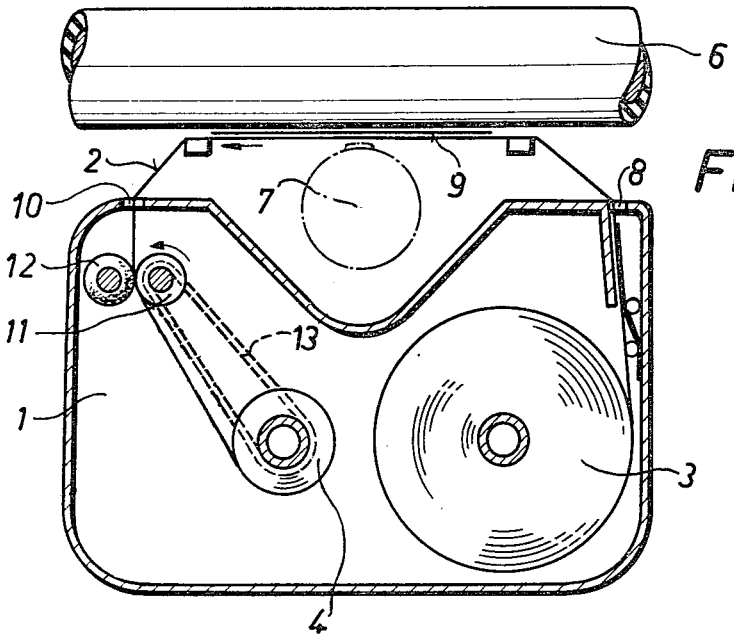
FIG.1
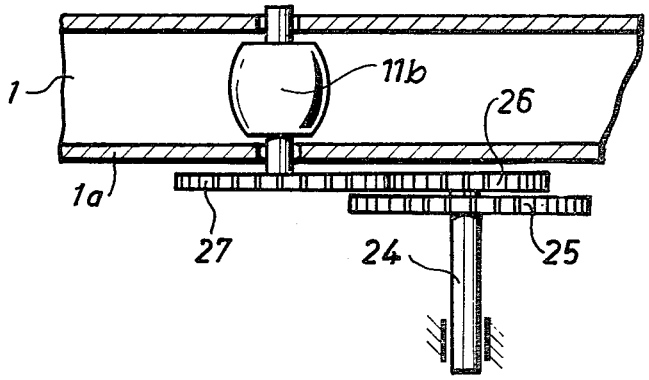
FIG. 4
FIG.5
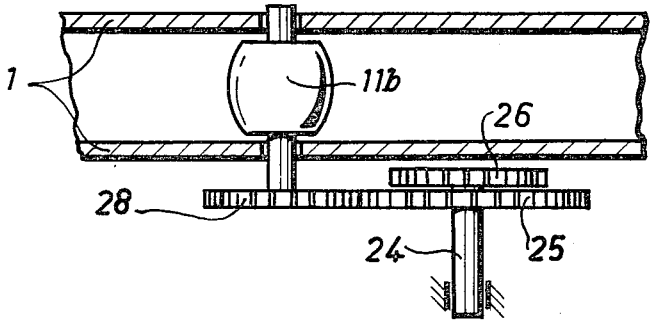

TYPEWRITER RIBBON FEED MECHANISM

BACKGROUND OF THE INVENTION

This invention relates to a feed mechanism for a cartridged ribbon used in typewriters or similar printing machines, wherein the feed of the ribbon is effected by driving a feed roller which is operatively connected to the ribbon. The feed roller is driven by a device which is mounted in the machine and which effects a stepped (intermittent) feed of different step sizes dependent upon the type of the ribbon.

In typewriters, data processing apparatuses, or similar machines using ribbon cartridges, generally multiple print textile ribbons, single print carbon ribbons or multiple print carbon ribbons are used. The multiple print textile ribbons are advanced back and forth from one spool to the other or are advanced as an endless ribbon loop and thus repeatedly move past the printing station. The single print carbon ribbons, on the other hand, move through the machine only once, since each surface portion of such ribbons may be utilized only a single time for printing. The mulitple print carbon ribbons too, pass through the machine only once; their individual surface portions, however, are adapted for multiple printing. In case of multiple print ribbons, the magnitude of the feed step (that is, the length of one incremental advance) is of no significance because each surface portion of the ribbon can be utilized repeatedly. In single print ribbons, however, the feed step has to be of such a magnitude that it corresponds to the entire width of the character. In case of multiple print ribbons, on the other hand—for the purpose of an economical utilization—a feed mechanism is needed which effects a feeding step of lesser magnitude.

It is generally known to provide a ribbon feed mechanism which, upon insertion of the respective ribbon cartridge, automatically switches to the operational mode (step length) assigned to that ribbon. Thus, according to U.S. Pat. No. 3,604,549, the cartridge has a configurational characteristic which varies the magnitude of the feeding step as a function of the kind of ribbon contained in that cartridge. The feed roller mounted in the machine is coupled to a ratio-changing transmission gear which is switchable in a positive manner by means of the configurational characteristic of the cartridge. Thus, in one setting of the ratio-changing transmission gear the magnitude of the feed step is such that it corresponds to the width of one character, whereas in another setting the advance of the ribbon is less than the character width and is thus of the overlapping kind relative to the characters.

SUMMARY OF THE INVENTION

It is an object of the invention to provide an improved ribbon feed mechanism of the above-outlined type for a selective step feed for a cartridged ribbon which is simplified in structure so that an arrangement for the automatic switch-over of the ratio-changing gear by conventional characteristics of the cartridge as well as a manual switching can be dispensed with.

This object and others to become apparent as the specification progresses, are accomplished by the invention, according to which, briefly stated, the ribbon driving device mounted in the machine has at least two driving components (output components) which run at different speeds and of which only a single one may be coupled to a feed roller mounted in the cartridge upon inserting the cartridge into the machine.

The feed mechanism according to the invention permits the use of a reduced number of structural components which leads to a smaller spatial requirement as well as a simplification of the manufacture, all resulting in substantial saving of costs.

According to a preferred embodiment of the invention, the driving device mounted in the machine has a common drive shaft on which there are mounted at least two spur gears of unlike diameters and at least two additional spur gears supported parallel to the drive shaft which mesh with the drive gears of the drive shaft continuously and which can be selectively coupled to the feed roller supported in the cartridge. In this manner, on the machine side, there are generated different rpm's by means of a non-switchable ratio-changing gear with several output components. In each instance a single output component can be coupled to the feed roller. It is the feed roller, particularly structured as a function of the type of ribbon in the associated cartridge, which selects the appropriate output component for coupling.

According to another preferred embodiment of the invention, the driving device mounted in the machine has a common drive shaft carrying at least two spur gears of unlike diameter and further, the feed roller mounted in the cartridge has a counter gear which can be coupled to a selected one of the spur gears and the size of which is determined by the particular kind of ribbon in the associated cartridge. According to this arrangement, at the machine side the drive components are driven with a constant rpm, but with different circumferential speeds.

In each instance, upon inserting the appropriate cartridge into the machine, there is established between the feed roller on the cartridge side and the respective drive component on the machine side a preselected driving connection, so that a step feed of different magnitude, dependent upon the type of ribbon contained in the respective cartridge can be effected without switching a ratio-changing gear.

BRIEF DESCRIPTION OF THE DRAWING

FIG. 1 is a top plan view, partially in section, of a ribbon cartridge inserted in a printing station and incorporating the invention.

FIG. 4 is a sectional side elevational view of another preferred embodiment of the invention, depicted in a first driving position.

FIG. 5 is a sectional side elevational view of the embodiment shown in FIG. 4, depicted in a second driving position.

DESCRIPTION OF THE PREFERRED EMBODIMENTS

Figure 2:
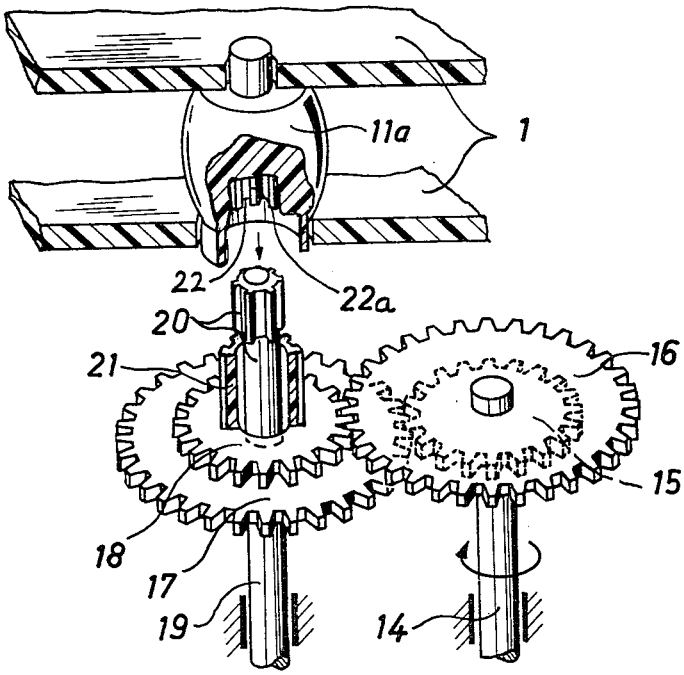
FIG. 2 is a perspective view, partially in section, of a preferred embodiment of the invention, depicted in a first driving position.

Turning now to FIG. 1, there is shown a ribbon cartridge 1 installed and ready for operation in a typewriter, data processing apparatus, or similar machine. The cartridge 1 accommodates a ribbon 2 which is supported on a supply spool 3 and a takeup spool 4 (or, in the alternative, the ribbon may be an endless loop). The removable cartridge 1 is insertable in the printing station of the machine, comprising a platen 6 and a type carrier 7 which may be, for example, a ball, a disc or a cylinder. The ribbon 2 which emerges from the cartridge 1 through an outlet slot 8 is threaded between a record-medium 9 supported on the platen 6 and the type carrier 7 and thereafter returns into the cartridge 1 through an entrance slot 10.

For advancing (feeding) the ribbon 2 there is provided a feed roller 11 which is supported in the cartridge 1 and which is rotated stepwise by a driving device mounted in the machine and discussed in more detail later. The ribbon 2 is pressed against the feed roller 11 by a pinch roller 12. For entraining the ribbon 2, the pinch roller 12 itself too, may be of an elastic material, such as rubber, so that it penetrates into the feed roller 11 without the use of an additional spring and is thereby deformed and clamps the ribbon 2. The takeup spool 4 is connected with the feed roller 11 by means of an endless elastic belt or a force-transmittingly effective spiral spring 13 for the frictional drive of the takeup spool 4 in a counterclockwise direction, as viewed in FIG. 1.

As the cartridge 1 is inserted in the printing station of the machine, the feed roller 11 is, at the same time, connected with a driving device which is supported in the machine and which provides a driving means for the feed roller 11 to advance the ribbon 2. The driving device effects, as it will be described below, a stepped feed of different step lengths for the ribbon 2, dependent upon the type of the ribbon 2.

Figure 3:
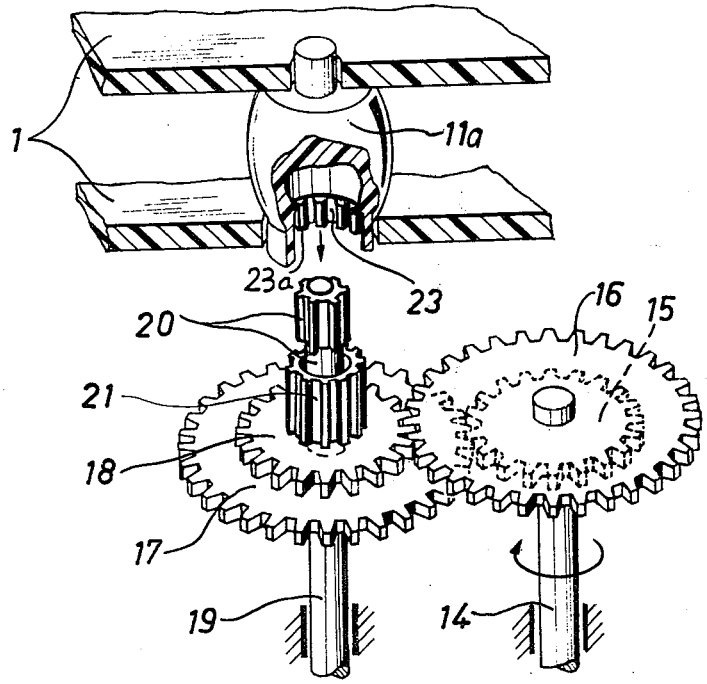
FIG. 3 is a perspective view of the same embodiment depicted in a second driving position.

FIGS. 2 and 3 illustrate a preferred embodiment of the invention.

Turning now specifically to FIG. 2, the driving device supported in the machine frame has a common drive shaft 14 which carries two superposed spur wheels 15 and 16 of unlike diameter. The driving device also has two further spur gears 17 and 18 which are supported for rotation about an axis parallel to the drive shaft 14. The lower spur gear 17 is, with its stub shaft 19, freely rotatably held in the machine frame and is in a continuous meshing engagement with the spur gear 15 of the drive shaft 14 and further has an externally toothed hub 20. The upper spur gear 18 is freely rotatably inserted on the hub 20 of the lower spur gear 17 and is in a continuous meshing engagement with the spur gear 16 of the drive shaft 14 and has, in turn, an externally toothed hub 21. As the drive shaft 14 is driven with a constant rpm, the two hubs 20 and 21 of the respective driven spur gears 17 and 18 rotate with different rpm's by virtue of the ratio-changing gears 15, 17 or, respectively, 16, 18. As it will be described in further detail later, upon inserting the cartridge 1, only one of the two hubs 20 and 21 can be operatively connected with the feed roller 11*a* of the associated cartridge 1.

The ribbon 2 accommodated by the cartridge 1 (FIG. 1) may be either a multiple print ribbon or a single print ribbon. A multiple print textile ribbon is moved repeatedly past the printing station and for this purpose it is wound on reversible spools 3 and 4. A single print carbon ribbon, on the other hand, passes only once through the machine; it is carried by spools 3 and 4 or is taken up by the spool 3 and is returned, after use, into the cartridge 1 and stored there in a zigzag manner. Dependent upon the particular kind of ribbon, the drive shaft 14, rotated stepwise always with the same rpm, is to generate feed steps of unlike lengths of the feed roller 11*a* and thus the ribbon 2. For this purpose, the feed roller 11*a* in each cartridge 1 is provided with a receiving opening 22 (FIG. 2) or 23 (FIG. 3) of different size dependent upon the kind of ribbon used in that particular cartridge 1. Thus, upon insertion of the cartridge 1, the feed roller 11*a* is automatically drivingly coupled with either the hub 20 or the hub 21 of the drive gears 17 and 18, respectively. The toothed hubs 20 and 21 constitute pinions adapted to mesh with circularly arranged inner gears 22*a* and 23*a* provided in the opening 22 or 23 of the feed roller 11*a*.

The relatively small-diameter inner gear 22*a* shown in FIG. 2 is designed to be drivingly coupled with the pinion 20 of the lower spur gear 17. The receiving opening 22 flares downwardly so that the latter at all times remains out of contact with the pinion 21 of the spur gear 18 which thus runs idle in the opening 22. By means of the coupling between the feed roller 11*a* and the spur gear 17, the ribbon 2 is advanced in relatively small feed steps.

Turning now to the structure illustrated in FIG. 3, the relatively large-diameter inner gear 23*a* arranged in the receiving opening 23 in the feed roller 11*a* is, upon insertion of the cartridge 1, drivingly coupled with the pinion 21 of the upper spur gear 18. The relatively large receiving opening 23 remains out of contact with the pinion 20, whose spur gear 17 thus runs idle. By virtue of the coupling of the feed roller 11*a* with the spur gear 18, the ribbon 2 is advanced in relatively large feed steps.

FIGS. 4 and 5 illustrate another preferred embodiment of the invention. The driving device mounted in the machine and illustrated in FIGS. 4 and 5 has a drive shaft 24 carrying two spur gears 25 and 26 which are rotated with the same rpm but which have, due to their unlike diameters, different circumferential speeds. Externally of the base 1*a* of the cartridge 1, the feed roller 11*b* carries a counter gear 27 (FIG. 4) or a counter gear 28 (FIG. 5) whose diameter is dimensioned as a function of the particular kind of ribbon 2 of the associated cartridge 1.

The counter gear 27 shown in FIG. 4 is of relatively large diameter. Upon inserting the cartridge 1 in the printing station, the counter gear 27 of the feed roller 11*b* assumes its meshing relationship with the spur gear 26. The drive of the feed roller 11*b* is effected by the spur gears 26, 27; as a result, the ribbon 2 is advanced in relatively small feed steps.

The counter gear 28 shown in FIG. 5 is of relatively small diameter. Upon insertion of the cartridge 1, the counter gear 28 is automatically coupled with the large-diameter spur gear 25. Thus, the drive is effected through the spur gears 25, 28, whereby the ribbon 2 is advanced with relatively large feed steps.

It is thus seen that a cartridge 1 incorporating the structure of FIG. 2 or FIG. 4 will accommodate a multiple print (multiple pass) ribbon 2, whereas a cartridge 1 incorporating the structure of FIG. 3 or FIG. 5 will house a single print (single pass) ribbon 2. The invention provides that while the drive shaft 14 (FIGS. 2 and 3) or the drive shaft 24 (FIGS. 4 and 5) always execute for each step the same angular displacement, the rotational angle of the step of the feed roller 11*b* depends upon the selective coupling of one of the output components 20, 21 (FIGS. 2 and 3) or 25, 26 (FIGS. 4 and 5) to the feed roller 11*b*.

It is thus seen that one and the same machine may use different types of ribbons which are stored in cartridges of indentical external configuration. Upon inserting the cartridge in the printing station, a different feed step length for the ribbon is achieved solely by virtue of the different design of the cartridge-supported drive elements for the feed roller, as determined by the type of the ribbon and thus no switching of any drive component is necessary. The spur gears supported in the machine and the counter gears supported in the cartridge may be spur gears with radially extending teeth. As seen, the invention provides a driving device and a ribbon cartridge which may be manufactured economically. In case the ribbon stored in the cartridge is used up or another type of ribbon is to be used, the cartridge is removed and another cartridge with a new, or, respectively, other kind of ribbon is inserted, whereby the step length assigned to the new ribbon is automatically set.

It is to be understood that the above description of the present invention is susceptible to various modifications, changes and adaptations, and the same are intended to be comprehended within the meaning and range of equivalents of the appended claims.

What is claimed is:

1. In a feed mechanism for advancing an ink ribbon, supported in a cartridge, in feeding steps whose length is determined dependent upon the type of the ribbon; the cartridge being insertable in, and removable from a typing machine; the feed machanism including a feed roller mounted in the cartridge and operatively connected with the ribbon for advancing the ribbon; the feed mechanism further including a driving device mounted in the machine and operatively connectable to the feed roller upon insertion of the cartridge in the machine; the improvement wherein said driving device has at least two output components arranged to rotate with unlike speeds; said feed mechanism further having coupling means mounted in said cartridge and continuously operatively connected with said feed roller; said coupling means connecting a selected one of said output components to said feed roller when said cartridge is in place in said typing machine; said coupling means being arranged as a function of the type of the associated ribbon for connecting said feed roller to said selected one of said output components.

2. A feed mechanism as defined in claim 1, wherein said driving device has (a) a drive shaft;

(b) at least two first gear wheels mounted on said drive shaft and having different diameters;

(c) at least two second gear wheels arranged in a continuous force-transmitting relationship with respective said first gear wheels; said second gear wheels being comprised in said output components; said coupling means operatively connecting a selected one of said second gear wheels to said feed roller when said cartridge is in place in said typing machine, whereby displacement of said drive shaft through a given angle of rotation results in different angular displacements of said feed roller dependent upon the selected second gear wheel.

3. A feed mechanism as defined in claim 2, wherein one of said second gear wheels has a hub on which the other of said second gear wheels is supported coaxially with and rotatably with respect to said one of said second gear wheels.

4. A feed mechanism as defined in claim 2, wherein said gear wheels are toothed gears.

5. A feed mechanism as defined in claim 2, wherein each of said second gear wheels has a hub; one of said second gear wheels being supported on the hub of the other of said second gear wheels coaxially with and rotatably with respect to said other of said second gear wheels; said coupling means including hub engaging means carried by said feed roller and dimensioned as a function of the type of said ribbon for being coupled to a selected one of said hubs when the cartridge is in place in said typing machine.

6. A feed mechanism as defined in claim 5, wherein each said hub has a free terminal portion formed as a pinion gear; said feed roller including means defining a receiving opening for accommodating said pinion gears; said hub engaging means including an inner gear arranged in said receiving opening for meshing with a selected one of said pinion gears.

7. A feed mechanism as defined in claim 1, wherein said driving device includes a drive shaft and at least two first gear wheels of unlike diameters mounted on said shaft and driven thereby; said coupling means including a second gear wheel mounted on said feed roller and connectable to a selected one of said first gear wheels; the diameter of said second gear wheel being a function of the type of ribbon contained in the cartridge, whereby displacement of said drive shaft through a given angle of rotation results in different angular displacements of said feed roller dependent upon the selected first gear wheel.

8. A feed mechanism as defined in claim 7, wherein said gear wheels are toothed gears.

* * * * *